US006158597A

United States Patent [19]

McDermott

[11] Patent Number: 6,158,597

[45] Date of Patent: Dec. 12, 2000

[54] HANGABLE CALENDAR ASSEMBLY

[75] Inventor: Amy J. McDermott, Unadilla, N.Y.

[73] Assignee: At-A-Glance, Inc., Sidney, N.Y.

[21] Appl. No.: 09/434,661

[22] Filed: Nov. 5, 1999

[51] Int. Cl.[7] ..... A47F 5/00

[52] U.S. Cl. ..... 211/45; 211/50; 211/89.01; 211/94.01; 211/DIG. 1; 248/206.5; 40/119

[58] Field of Search ..... 211/45, 50, 89.01, 211/94.01, 46, DIG. 1; 40/107, 119, 121; 248/206.5, 205.3; 402/80 P, 503, 57

[56] References Cited

U.S. PATENT DOCUMENTS

| | | | |
|---|---|---|---|
| 923,412 | 6/1909 | Dannheiser . | |
| 1,428,900 | 9/1922 | Oppenheimer . | |
| 2,940,455 | 6/1960 | Guichard | 129/16 |
| 2,943,246 | 6/1960 | Riordan . | |
| 3,168,954 | 2/1965 | Von Herrmann | 211/50 |
| 3,212,794 | 10/1965 | Crossan et al. | 281/15 |
| 3,399,429 | 9/1968 | Goodman | 24/66 |
| 3,513,579 | 5/1970 | Christensen . | |
| 3,591,013 | 7/1971 | Von Herrmann | 211/50 |
| 3,606,507 | 9/1971 | Williams, Jr. et al. | 312/184 |
| 3,814,368 | 6/1974 | Freed | 248/316 |
| 4,010,517 | 3/1977 | Kapstad | 24/67.11 |
| 4,105,127 | 8/1978 | Holl | 211/124 |
| 4,232,462 | 11/1980 | Longenecker | 40/119 |
| 4,629,075 | 12/1986 | Hutten | 211/89 |
| 4,773,545 | 9/1988 | Jones | 211/89 |
| 4,793,495 | 12/1988 | Preu | 211/94.01 X |
| 4,899,974 | 2/1990 | Wear et al. | 248/467 |
| 4,907,769 | 3/1990 | Hunley, Jr. et al. | 248/185 |
| 4,953,714 | 9/1990 | Paul | 211/36 |
| 5,031,782 | 7/1991 | Minervini | 211/94.01 X |
| 5,096,069 | 3/1992 | Brandon | 211/45 |
| 5,249,336 | 10/1993 | Miller | 24/67.5 |
| 5,645,254 | 7/1997 | Ng et al. | 248/206.2 |
| 5,711,430 | 1/1998 | Andersen et al. | 211/45 |
| 5,910,351 | 6/1999 | Davis et al. | 428/100 |

*Primary Examiner*—Robert W. Gibson, Jr.
*Attorney, Agent, or Firm*—Lawrence P. Trapani, P.C.

[57] ABSTRACT

A hangable wall calendar has a stack of sheets that are bound at one edge with a spiral binding or other suitable flip binding. The calendar may have a stitch binding, or be cloth-bound or stapled. An elongated generally tubular hanger member for the calendar has a generally D-shaped profile, with a magnetic strip on the back and a slot running along a bottom wall. The slot is narrower than the diameter of the flip binding but large enough to accomodate the stack of sheets. The calendar can be slipped out of the holder and flipped to a different sheet, and then slid back into place. Alternatively, the hanger member can have a generally P-shaped profile.

14 Claims, 3 Drawing Sheets

HANGABLE CALENDAR ASSEMBLY

BACKGROUND OF THE INVENTION

The present invention relates to wall calendars and other types of flat reference and stationery products in which leaves or sheets of paper are loosely bound. The invention is more specifically directed to an hangable calendar in combination with a tubular hanger that can be attached to a ferromagnetic vertical surface, to wit, by a magnetic strip to a refrigerator door or steel cabinet.

Wall calendars and similar reference planners and charts are usually attached to a wall by means of a permanent fastener, e.g., a nail or picture hanger, or with an adhesive such as two-sided tape. At the end of any month the calendar has to be changed to the next month. In the case of a wire-bound calendar this can be done by removing the calendar from the wall and flipping the leaves or sheets until the proper month is in front. When there is a need to look ahead to a future month for planning purposes, then it may also be necessary to flip to that sheet.

Many modern offices and homes have cabinets, appliances, or partitions made of steel, so that items can be attached to them magnetically. A typical example is a refrigerator, which provides a vertical surface for mounting items for display. Accordingly, it would be useful if a calendar were provided with suitable means for attaching magnetically to a vertical ferromagnetic surface, such as a refrigerator or cabinet. However, no suitable hangers for calendars have been available.

OBJECTS AND SUMMARY OF THE INVENTION

Accordingly, it is an object of this invention to provide a wall calendar or similar reference or management item with a magnetic hanger that permits the wall calendar to be attached magnetically to a vertical surface.

It is a more specific object to provide a magnetic hanger for a calendar that permits the calendar to be easily removed, flipped to a new month, and then reinserted.

According to an aspect of this invention, a hangable calendar assembly has a calendar and a holder. The calendar comprises a stack of sheets each having a top edge, and a flip binding, e.g., a spiral binding or a series of rings, at the top edge. Alternatively, the flip binding may be a saddle-stitched or fabric binding, or a stapled binding. The stack of sheets can be flipped or folded so that any of the sheets is positioned at the front of the stack. The flip binding has a predetermined diameter that is larger than the thickness of said stack, and, in the case of a saddlestitch binding, a thin profile when the paper sheets are folded. The hanger includes an elongated tubular member having an inner diameter that is larger than the diameter of the flip binding, and could have an extended clip. A slot extends along the tubular member and has a length sufficient to accommodate the stack of sheets. The slot has a width that is at least as great as the stack thickness of but less than the diameter of the flip binding, but can be extended to include a clip. A magnetic strip or similar attaching means is disposed on a flat wall of the tubular member for attaching same to a vertical surface. The flip binding can be a wire spiral binding, or can be formed as a series of rings. The flip binding may be flat, with saddle-stitched binding. The tubular member can be extruded semi-rigid plastic, with a generally D-shaped profile. The attaching means can be a magnetic strip extending along a flat side of said tubular member. The slot for the calendar can be formed in a bottom wall of the D-shaped profile. The tubular member may have a P-shaped profile, with a back wall that extends down from the arcuate top portion, and with a parallel front wall, the facing surfaces of the front and back walls defining a clip.

The calendar assembly of this invention is simple to install and to use. The spiral or ring binding, or saddle-stitched binding, can slide out one end of the holder, and the calendar can be flipped, i.e., folded, to a new page, i.e., a new month, and then repositioned in the holder by sliding or slipping it into the slot. The calendar can be removed and replaced whenever necessary, i.e., for making notes on the calendar. The calendar can be placed on a desk, table or other flat surface for this, rather than needing to make notes on the calendar while it is hanging.

The assembly of this invention can be used for other multi-sheet planners or charts, wherever it is desired to mount same on a steel wall or other similar vertical surface, and where it would be useful, from time to time, to position a different sheet in front.

In some embodiments, the flip binder may be formed of openable split-ring binder ring members, so that sheets or pages can be changed or replaced.

The above and many other objects, features, and advantages of this invention will become apparent from the ensuing description of a selected preferred embodiment, which should be read in connection with the accompanying Drawing.

DETAILED DESCRIPTION OF A PREFERRED EMBODIMENT

Figure 1:
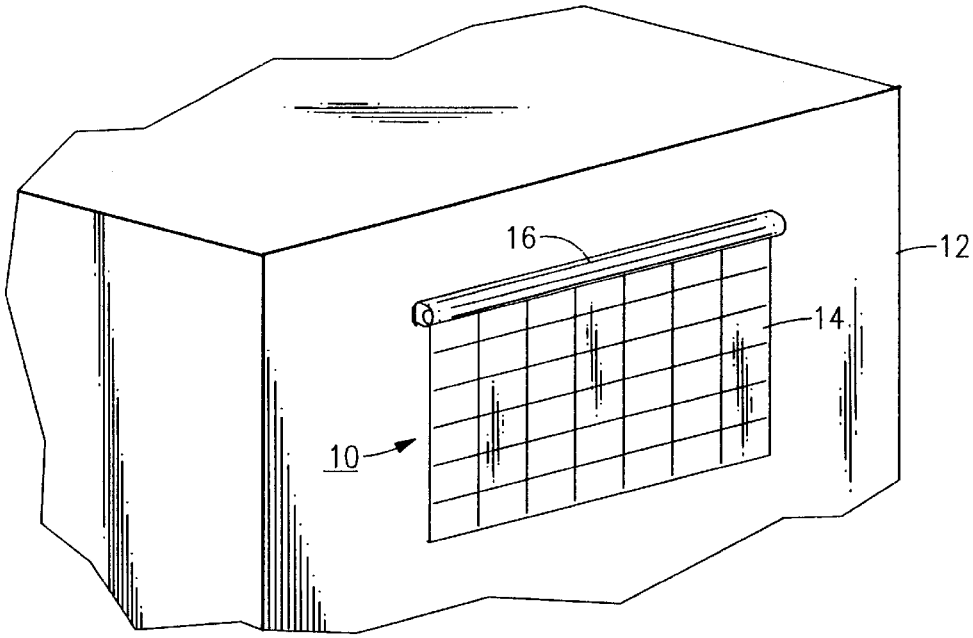
FIG. 1 is a perspective view of a flip-binding calendar assembly according to an embodiment of this invention, here positioned on a vertical wall of a cabinet.
Figure 2:
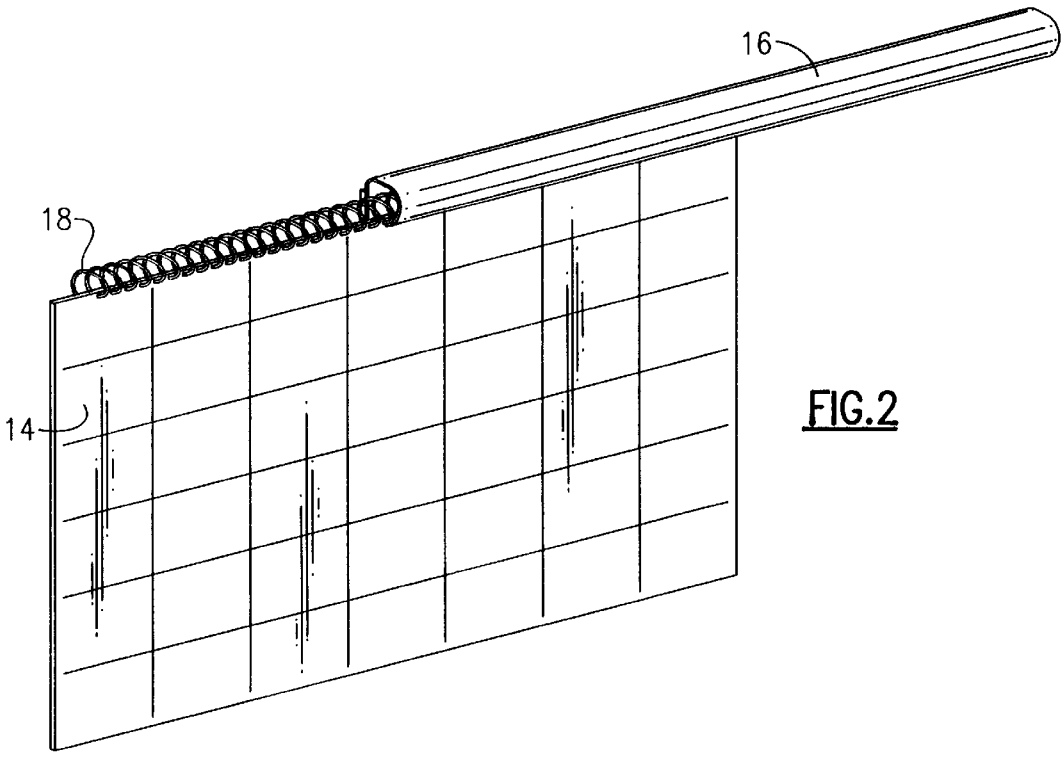
FIG. 2 is a perspective view showing the flip binding calendar sliding into the holder of this embodiment.

With reference to the Drawing, FIG. 1 shows a calendar assembly 10 hanging from a vertical steel surface 12, e.g., the door of a refrigerator or other steel cabinet. The calendar assembly 10 is in the form of a stack 14 of pages or sheets of paper or other suitable material, e.g., plastic. In this embodiment, the calendar is shown as a blank grid, but in other embodiments the calendar can have the dates preprinted, or can have other information included. Alternatively, the sheets of paper can carry other graphic material, such as photographs, management charts, or other graphics and aids as suits the user's demands. A tubular holder 16 is magnetically attached onto the vertical steel surface 12, and is adapted for removably receiving the calendar. As shown in FIG. 2, the stack of sheets 14 is loosely bound on a spiral binding arrangement that is positioned along an upper edge of the stack 14. The spiral binding can be a familiar wire binding, although other bindings are possible, including a series of rings. The binding 18 permits the sheets to be flipped over so that a desired one of the sheets is positioned in front, e.g., to begin a new month.

Figure 3:
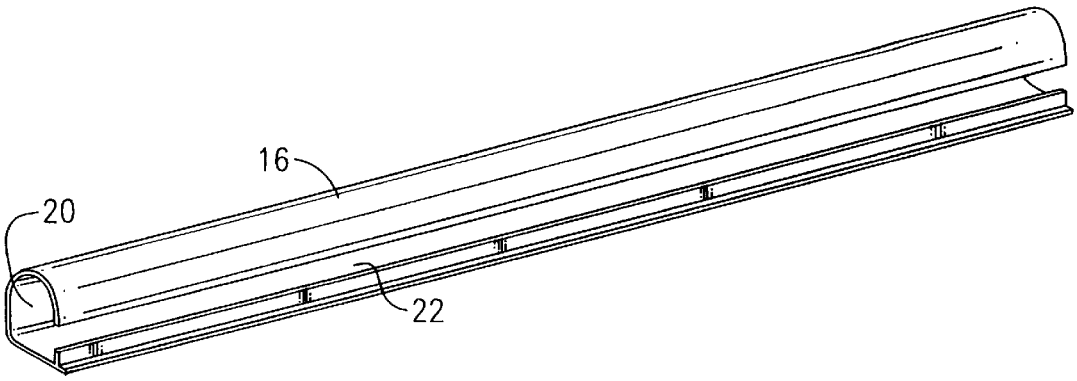
FIG. 3 is an perspective view of the magnetic calendar holder of this embodiment.
Figure 4:
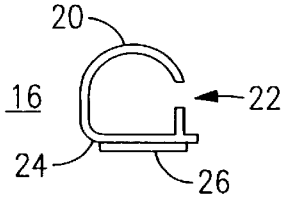
FIG. 4 is a cross-sectional view of the holder.

As shown in FIGS. 3 and 4, the holder 16 of this embodiment is in the form of an elongated tubular extrusion, e.g., of a semirigid plastic material. The holder could also be aluminum or other material. The tubular holder 16 has a generally D-shaped profile, with a loop portion 20 at its front. There is a gap or slot 22 formed at a bottom of the D-shaped profile, and extending the length of the holder. Here, the slot 22 is open at both ends, but in other embodiments the slot may be open at one end only. There is a flat side wall 24 at the back of the holder 16, and a strip of magnetic material 26 is attached here for magnetically attaching the holder to the ferromagnetic material of the vertical surface 12. In other possible embodiments, other attaching means could be used, such as double-sided tape for adhesively adhering to a vertical surface. A small flange 28 projects down from the gap side or lower side of the flat side wall, to provide support.

Figure 5:
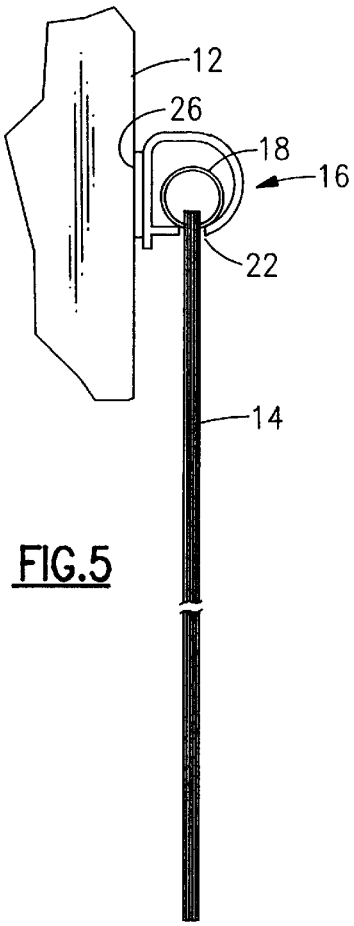
FIG. 5 is a side elevation showing the flip-binding calendar in place in the magnetic holder of this embodiment.

As shown in FIG. 5, the tubular holder 16 has an inner diameter that is somewhat larger than the diameter of the spiral binding 18, and the slot 22 is slightly wider than the total or accumulative thickness of the stack of sheets 14. The slot is also narrower than the diameter of the spiral binding 18.

The arrangement as described and illustrated here permits the calendar to be slipped sideways in and out of the holder 16 whenever desired. This may be useful, e.g., for placing the stack of sheets onto a flat surface, i.e. a desk or table, for writing onto it. This also makes it possible to flip to a new sheet, i.e., a different month, and then quickly slide the calendar back into position in the holder.

The sheets in the stack 14 can be one-sided, or can be printed on both sides. In the latter case, the calendar can be reversed front-for-back and slid back into the holder to display the back. In other embodiments, covers can be provided for the ends of the holder 16. In still other embodiments, the holder can have a different cross-section or profile.

Figure 6:
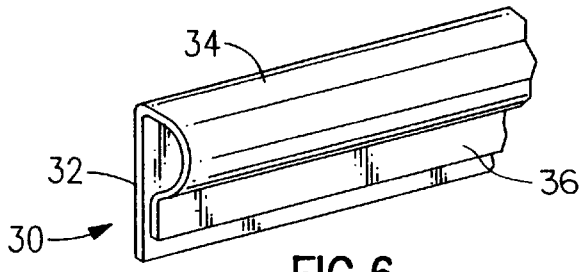
FIG. 6 is a perspective view of a magnetic calendar holder of a second embodiment.
Figure 7:
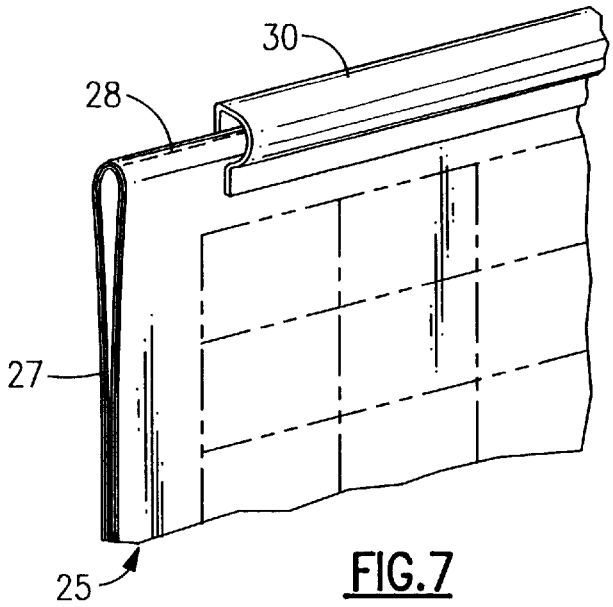
FIG. 7 is a perspective partial view of a saddle-stitched calendar and holder of the second embodiment.
Figure 8:
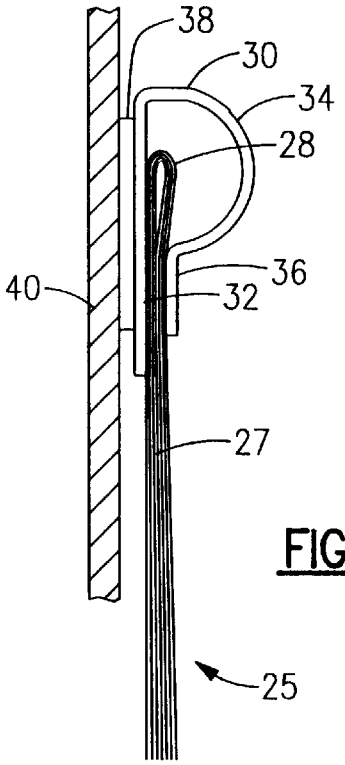
FIG. 8 is an side view of the second embodiment.

A second embodiment of this invention is illustrated in FIGS. 6, 7 and 8. In this second embodiment, a calendar 25 is formed of a stack of sheets 27 that are fastened together with a saddle-stitch binding 28, so that when the stack 27 is bent at the binding there is a top portion or top edge of the calendar. Alternative to the saddle stitching, the calendar may be cloth bound or stapled. In this embodiment the tubular hanger 30 has a P-shaped profile, with a flat back wall 32 and an arcuate portion 34 at the top and front. The arcuate portion 34 defines an elongated tubular opening for the top of the calendar. A flat front wall 36 extends downward from the lower edge of the arcuate portion 34, with the back wall 32 extending further down than the front wall 36. A magnetic strip 38 is attached onto the back surface of the back wall 32 for magnetic attachment to a steel vertical surface 40. In this embodiment, the front and back walls 32, 36 combine to serve as a clip or clamp for the stack 27 of sheets held between them. The P-shaped profile, and the thickness geometry formed at the binding 28 and associated fold-overs of the sheets, assist the holder 30 in holding the calendar 25 in place. The clamping force here is gentle enough so that the calendar can be easily slid out and in, for example, when necessary to turn to a new month.

While this invention has been described with reference to a selected preferred embodiment, it should be understood that the invention is not limited to that precise embodiment. Rather, many modifications and variations will present themselves to persons skilled in the art without departing from the scope and spirit of this invention, as defined in the appended claims.

I claim:

1. Hangable calendar assembly comprising a stack of sheets each having a top edge with said stack having a predetermined accumulative thickness; a flip binding at said top edge binding said sheets such that the stack of sheets can be flipped so that any of said sheets is positioned at a front of said stack, the flip binding having a predetermined diameter that is larger than the predetermined accumulative thickness of said stack; an elongated tubular hanger member having an inner diameter that is larger than the diameter of said flip binding, with a slot extending along said tubular member and having a length sufficient to accommodate said top edges of said stack of sheets, said slot having a width that is at least as great as the accumulative thickness of said stack but less than the diameter of said flip binding; and attaching means disposed on said tubular member for attaching same to a vertical surface.

2. Hangable calendar assembly according to claim 1, wherein said flip binding includes a spiral binding.

3. Hangable calendar assembly according to claim 1, wherein said flip binding includes a series of rings.

4. Hangable calendar assembly according to claim 1, wherein said flip binding includes a saddle-stitched binding.

5. Hangable calendar assembly according to claim 1, wherein said tubular member is of a generally D-shaped profile.

6. Hangable calendar assembly according to claim 5, wherein said attaching means includes a magnetic strip extending along a flat side of said tubular member.

7. Hangable calendar assembly according to claim 5, wherein said slot is formed in a bottom wall of said D-shaped profile.

8. Hangable calendar assembly according to claim 1, wherein said attaching means includes magnetic means for attaching the tubular member to a ferromagnetic surface.

9. Hangable calendar assembly comprising a stack of sheets each having a top portion with said stack having a predetermined accumulative thickness; a flip binding at said top portion and binding said sheets such that the stack of sheets can be flipped so that any of said sheets is positioned at a front of said stack; an elongated tubular hanger member having a flat back wall, an arcuate top front portion, and a flat front wall extending from said arcuate wall downwards and parallel to said back wall, said tubular member having a length sufficient to accommodate said flip binding on said stack of sheets, such that said stack of sheets can slide into said hanger member between said front wall and said back wall, so that when the stack of sheets is so positioned the hanger member supports said stack of sheets with the flip binding in said arcuate top portion; and attaching means disposed on said back wall for attaching same to a vertical surface.

10. Hangable calendar assembly according to claim 9, wherein said elongated tubular member has a generally P-shaped profile.

11. Hangable calendar assembly according to claim 9, wherein said back wall extends downward further than said front wall.

12. A method of mounting a calendar on a vertical surface, in which the calendar includes a stack of sheets each having a top edge with said stack having a predetermined thickness, and a flip binding at said top edge binding said sheets such that the stack of sheets can be flipped so that any of said sheets is positioned at a front of said stack, the flip binding having a predetermined diameter that is larger than the predetermined thickness of said stack; the method comprising installing on said vertical surface an elongated tubular hanger member having an inner diameter that is larger than the diameter of said flip binding, with a slot extending along said tubular member and having a length sufficient to accommodate the top edges of said stack of sheets, said slot having a width that is at least as great as the accumulative thickness of said stack but less than the diameter of said flip binding; and sliding said calendar into said slot so that said flip binding is within the tubular member.

13. The method of claim 12, wherein said installing includes magnetically attaching the tubular hanger member onto said vertical surface.

14. The method of claim 12, further comprising sliding the calendar out of said slot, flipping the stack of sheets so that a different sheet is in front, and sliding the calendar back in the slot.

* * * * *